US006474593B1

(12) United States Patent
Lipeles et al.

(10) Patent No.: US 6,474,593 B1
(45) Date of Patent: Nov. 5, 2002

(54) GUIDED BULLET

(76) Inventors: Jay Lipeles, 461 Majestic Oaks Dr., Apopka, FL (US) 32712; R. Glenn Brosch, 30713 CR 437, Sorrento, FL (US) 32776

( * ) Notice: Subject to any disclaimer, the term of this patent is extended or adjusted under 35 U.S.C. 154(b) by 24 days.

(21) Appl. No.: 09/733,291

(22) Filed: Dec. 8, 2000

Related U.S. Application Data

(60) Provisional application No. 60/170,192, filed on Dec. 10, 1999.

(51) Int. Cl.[7] ..... F42B 10/00

(52) U.S. Cl. ..... 244/3.21; 244/3.24; 244/201; 244/204; 244/213; 102/501

(58) Field of Search ..... 244/3.1, 3.21, 244/3.24, 75 R, 201, 204, 213–215; 102/501, 517

(56) References Cited

U.S. PATENT DOCUMENTS 4,054,254 A * 10/1977 Cole ..... 244/3.21
4,266,339 A 5/1981 Kalt
5,775,636 A * 7/1998 Vig et al. ..... 244/3.21
5,788,178 A * 8/1998 Barrett, Jr. ..... 244/3.21
6,071,819 A * 6/2000 Tai et al. ..... 438/694
6,163,021 A * 12/2000 Mickelson ..... 244/3.1
6,283,407 B1 * 9/2001 Hakenesch ..... 244/3.21
6,302,360 B1 * 10/2001 Ng ..... 244/203

OTHER PUBLICATIONS

Liu et al, Out–of–Permalloy Magnetic Actuators for Delta–Wing Control, IEEE pp. 7–12, 1995.*
Excerpt from Commerce Business Daily dated Dec. 22, 2000 and Associated Statement of Work.

* cited by examiner

*Primary Examiner*—Harold J. Tudor
(74) *Attorney, Agent, or Firm*—David G. Maire; Beusse Brownlee Bowdoin & Wolter, PA

(57) ABSTRACT

A projectile having a plurality of micro electromechanical (MEMS) devices disposed about the axis of flight for active control of the trajectory of the projectile. The MEMS devices each form an integral control surface/actuator. Control circuitry installed within the projectile housing includes both rotation and lateral acceleration sensors. Flap portions of the MEMS devices are extended into the air stream flowing over the projectile in response to the rate of rotation of the projectile, thereby forming a standing wave of flaps operable to impart a lateral force on the projectile. MEMS devices utilizing an electrostatically controllable rolling flap portion provide a large range of motion while consuming a small amount of power. The MEMS devices may be arranged in longitudinal strips along an ogive portion of the projectile. Packaging concepts for projectiles as small as a 30 caliber bullet are described.

14 Claims, 2 Drawing Sheets

GUIDED BULLET

This application claims benefit of the filing date of provisional U.S. patent application No. 60/170,192 filed Dec. 10, 1999.

BACKGROUND OF THE INVENTION

The present invention relates generally to the field of airborne vehicles, and more specifically to a guidance system capable of being used on a small airborne projectile such as a bullet.

The path of a gun-launched projectile is at the mercy of gravity, air currents, muzzle accuracy, barrel wear, sighting accuracy, gun stability, projectile anomalies, charge uniformity, etc. As with a golfer who leans after a shot to encourage the ball to travel one way or the other, one would similarly like to influence the flight path of a bullet to overcome the above disturbances and to deliver the projectile to its intended target. The least expensive weapon for the last several centuries has been a bullet. Although bullets themselves are very inexpensive, they are not always the most cost effective. That is, the real cost of using a weapon includes the cost of all the ammunition plus the cost of delivery necessary to achieve the desired objective. Thus, a more expensive bullet that has a greater accuracy may actually be a less expensive bullet to use.

Most bullets spin about their axis of flight and are thereby spin stabilized. Equipping such a projectile with guidance vanes or other control devices would be useless unless the control devices could be activated only at such times and for an appropriate duration when they could impose the control force in the appropriate direction, and then be retracted when their affect would be inappropriate or counter to the desired flight path correction. Obviously such operation would mean very rapid projection and retraction of the guiding aspects, i.e. a wide bandwidth control system. Traditional control systems are not capable of such rapid deployment. To avoid the need for such a wide bandwidth control system, it is known to de-spin the section of the projectile that houses the control devices. The de-spun section may then be roll stabilized with respect to inertial space. In such a state, the control section moving axially through the air could activate relatively slow moving control devices without subjecting them to the roll of the bullet.

Micro electromechanical systems (MEMS) have been developed based upon a variety of technologies for a variety of applications. An electrostatic actuator using a rolling electrode is described in U.S. Pat. No. 4,266 339 issued to Kalt on May 12, 1981, for application as an electronic window blind.

MEMS actuators have been tested on military aircraft as part of a flight control system for reducing the buffeting forces imposed on the aircraft vertical fin resulting from local flow condition instability. Piezoelectric actuators were used in this test. Although the speed of movement of such actuators is sufficiently high to respond to local flow instabilities, the effectiveness of such piezoelectric actuators is limited because the range of motion of a piezoelectric material is relatively small.

BRIEF SUMMARY OF THE INVENTION

There is a particular need for a guidance control system that is small enough and fast-acting enough to be applied to a projectile as small as a bullet. Accordingly, an airborne vehicle is described herein as having a housing; a plurality of micro electromechanical actuators attached to the housing, each actuator having a flap portion adapted to move between a withdrawn position and an extended position; and actuator circuitry connected to the actuators for selectively moving ones of the flap portions into and out of an air stream passing over the projectile. The airborne vehicle may further include a rotation sensor for producing a first signal corresponding to the rotation of the projectile about an axis of flight; a lateral acceleration sensor for producing a second signal corresponding to acceleration of the projectile in a direction normal to the axis of flight; and control circuitry connected to the rotation sensor and to the lateral acceleration sensor for providing a third signal to the actuators responsive to the first and the second signals. The plurality of actuators may be arranged about the axis of flight, and wherein the third signal is operable to extend selected ones of the flap portions to produce a standing wave of extended flap portions relative to the axis of flight.

A method of controlling the trajectory of an airborne vehicle is describe herein as including the steps of: providing a plurality of micro electromechanical actuators on a projectile, each actuator having a flap portion adapted to move between a withdrawn position and an extended position; determining a desired change in trajectory of the projectile relative to an axis of flight; and actuating a selected portion of the actuators to extend the respective flap portions into and out of an air stream passing over the projectile to achieve the desired change in trajectory. The method may further include the steps of: disposing the actuators on the airborne vehicle about the axis of flight; sensing rotation of the projectile about the axis of flight; and actuating the selected portion of the actuators in a sequence responsive to the rotation of the projectile to form a standing wave of extended flap portions relative to the axis of flight.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
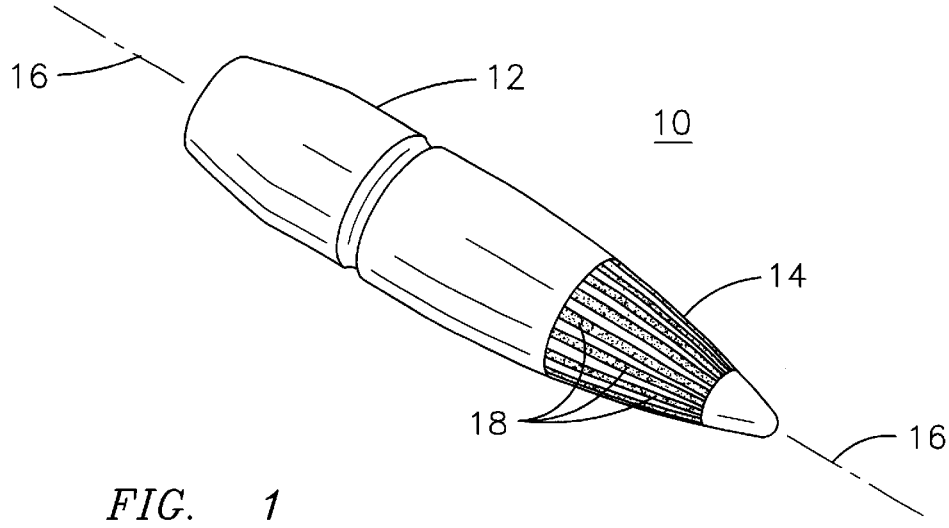
FIG. 1 is a perspective view of a projectile having a plurality of micro electromechanical actuators arranged in strips along its ogive section.

FIG. 1 illustrates a projectile 10 having a housing 12 with a front ogive section 14 with a tapered thickness relative to an axis of flight 16. Projectile 10 is illustrative of any sort of airborne vehicle that may be built in accordance with the present invention. The term airborne vehicle is used generally herein to include any of the following types of vehicles: airplane, rocket, missile, projectile, rocket assisted projectile, bullet, lifting body, etc. The housing 12 is illustrative of any appropriate portion of an airborne vehicle to which a control surface may be attached, for example a fuselage, wing, fin, body, etc. The projectile includes a plurality rows or strips 18 of flight control devices disposed about the axis of flight 16. The trajectory of the projectile may accordingly be affected by actuation of selected ones of the flight control actuators, as will be described more fully below.

Figure 2:
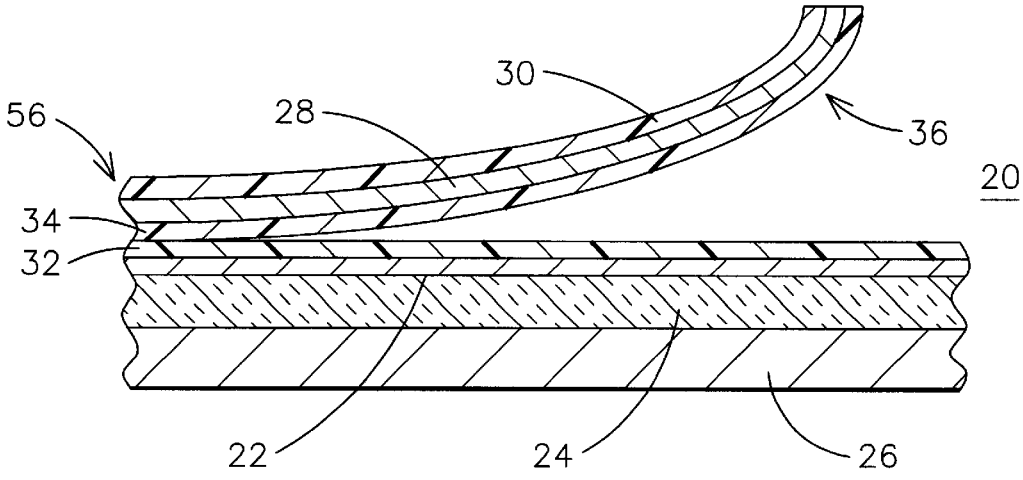
FIG. 2 is a cross-sectional view of one of the micro electro-mechanical actuators of the projectile of FIG. 1.

FIG. 2 is a partial cross-sectional view of one of the flight control devices 20 of the projectile 10 of FIG. 1. Flight control device 20 is an electrostatic flexible film device having a first fixed electrode 22 disposed on a layer of insulating material 24 supported on a substrate 26. A second flexible electrode 28 is deposited on a tentured layer of polymer 30. The tentured material is formed to have internal tensile stresses resulting from the method of manufacturing use to form the device. The fixed electrode 22 and the flexible electrode 28 are separated from each other by respective layers 32,34 of a polymer material. Together, tentured layer 30, electrode 28 and polymer layer 34 form a flap portion 36 that is adapted to move between an extended position (as illustrated) and a withdrawn position wherein flexible electrode 28 is drawn toward fixed electrode 22 so that flap portion 36 is unrolled to lay against the substrate 26. Thus the flight control device 20 forms an integral control surface/actuator.

Figure 3:
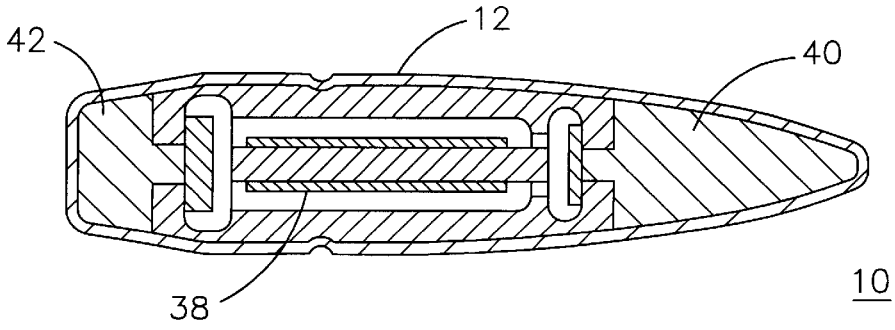
FIG. 3 is a cross-section view of the projectile of FIG. 1.

FIG. 3 is a cross-sectional view of projectile 10. Housing 12 contains a control system 38 operable to affect the in-flight trajectory of the projectile 10. Housing 12 also contains both nose ballast 40 and aft ballast 42 selected to provide desired flight characteristics for projectile 10. In one embodiment, projectile 10 may be designed as a replacement for a standard bullet, and since the electronic components are composed of materials that are less dense than steel, the ballast 40,42 is selected to provide inertial characteristics (center of gravity, weight, etc.) for projectile 10 that are as close to the original bullet characteristics as possible.

Figure 4:
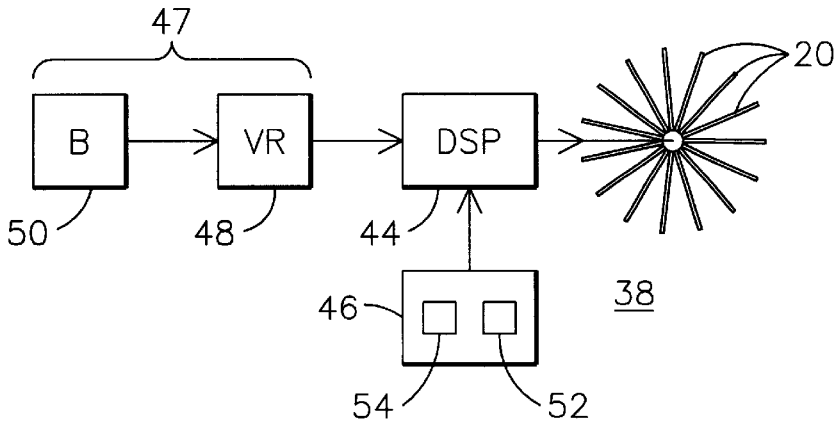
FIG. 4 is a block diagram of the control system for the projectile of FIG. 1.

FIG. 4 is a block diagram of control system 38 of projectile 10. Control system 38 may be designed upon a flex circuit that may be rolled/folded to fit within the available housing interior space. The control system 38 must withstand gun-imposed loads. The electronics package is small and will be fully potted. Individual wires and their terminations are most vulnerable to acceleration loading and should be avoided. A digital signal processor 44 receives input from an inertia motion unit 46 for control of an array of micro electromechanical systems actuators 20. Control system 38 also includes power supply 47 including a voltage regulator and battery 50.

System Excelerator's (SEI) digital signal processor (DSP) system currently utilizes a 52 MHz device with on-chip SRAM and a micro-chip A/D to process up to 16 channels of sensor data in real time. Coupled with a new operating system resident in internal DSP memory, the DSP provides both real time computation and control to process multiple sensors effectively. New 16-bit DSP's now push the silicon technology envelope, taking advantage of silicon processes and fabrications, to clock at 75 MHz with up to 250 MB of on-chip SRAM. These upgraded devices provide the computational power and memory necessary to compute the precession and nutation frequencies, to enhance and process the accelerometer signals, and to carry out the auto-pilot functions that will be described more fully below. Expected improvements in DSP architecture will quickly remove computational power from being a limiting design feature for the projectile 10.

The inventors believe that the projectile 10 may be packaged in embodiments as small as a 50 caliber bullet, or even a 30 caliber bullet. The small volume of a rifle bullet is the overwhelming design constraint for the projectile of the present invention. There is no room for conventional controls, nor is there room for a battery large enough to power them. There is no room for a terminal guidance seeker. There is insufficient area for a GPS antenna, and even if there were, there is insufficient flight time to acquire the GPS constellation and to make useful guidance corrections.

The inertial motion unit 46 includes an angular rate rotation sensor 52 and a lateral acceleration sensor 54 consisting of two COTS accelerometers similar to those developed for the automobile industry for air bag and roll-over sensors. These devices are surface mounted MEMS devices and are very small and relatively inexpensive. They are mounted to a motherboard at the centerline of the projectile to measure motions in the two transverse ortho-normal directions to produce a first signal corresponding to the rotation of the projectile 10 about the axis of flight 16 and a second signal corresponding to acceleration of the projectile normal to the axis of flight. Known techniques for signal processing may be used to improve the accuracy of these signals.

Recently introduced integrated circuits that provide efficient up-conversion of single cell batteries for mobile personal computers may be used to create a voltage regulator 48. These micro-powered devices provide 3 or 5 volt operation for cells that vary all the way down to 1.6 volts during discharge.

It is expected that the available volume will be too small for a workable thermal battery, since with such a small volume there may be insufficient thermal mass for the battery to sustain temperature. Thin film batteries may be made quite small and offer a viable alternative. Such batteries can have any shape provided the electrolyte completely isolates the cathode from direct contact with the anode. Lithium batteries offer another alternative. Several thin pouch-like lithium batteries have been stacked together and gun fired successfully in the United States Army HSTSS program. Solid lithium-polymer batteries have begun to enter the mobile PC market and may be another alternative. Another approach would be to use battery 50 to charge a capacitor, which would activate actuators 20 through a voltage boosting circuit. Because MEMS actuators 20 are electrostatic devices, they require essentially no current and only about 50 volts. Finally, lithium/manganese dioxide cells offer another alternative source of the necessary electrical energy. An inertial switch will be triggered by the firing load imposed on the projectile. An electronic latch will secure the switch so that power is retained after the initial launch load and throughout the projectile's flight.

The self-compensating disturbance compensating system described herein includes means to sense accelerations, processing to extract the amplitude of disturbance accelerations, and a means of effecting a compensating force with the appropriate spin phasing relative to the disturbance. The spin and nutation are high in frequency as compared to the disturbance phenomena. They are also well behaved harmonics that lend themselves to simple signal processing. This concept exploits the spin and residual nutation motion as a carrier signal. A body fixed accelerometer will sense the aerodynamic acceleration caused by the coning angle. The direction of the cone angle, and thus the acceleration direction, rotates in inertial space at the nutation frequency. Additionally, the sensed acceleration is modulated at the spin frequency. These two frequencies are simple multiples of one another as determined by the ratio of the moments of inertia. Simple processing can be used to extract differences in these modulations due to lower frequency disturbances. The traditional bane of spinning projectile guidance is keeping up with the roll angle. Fortuitously, it is not necessary to determine the direction of the disturbance in inertial space. It is only necessary to issue the corrections in-phase with the disturbance in body coordinates. Disturbances due to wind, wind shear, gust, tip-off, rain and particulates in the atmosphere, imperfections in the gun or bullet, gravity bias, etc. will excite precession and nutation. By measuring the amplitude of these responses and using them as parameters to develop a feedback signal to the control system actuators 20, the precession and nutation will be minimized and the trajectory corrected. The device described herein is a semi-smart bullet; that is, it does not have command or terminal guidance. Volume limitations preclude such features. It does, however, have an active guidance and a control system that will counter the effects of errors or disturbances that would alter the path of the bullet from its ideal trajectory. The bullet 10 will go where it was sent.

Conventional flight control devices are not possible in such a small application. Methods of flow control include geometric shaping of the airfoil, vortex generators for separation control, longitudinal grooves or riblets to reduce drag, and the use of mechanical flow deflectors to modify the flow field. The MEMS devices 20 described herein provide low power consumption, fast response, reliability and low cost. Integral control surface/actuator 20 may be fabricated with methods developed for the fabrication of silicon chips. Only five photo-lithographic steps are required to form a simple actuator. These steps can be accomplished with conventional, prior generation VLSI equipment, including contact photolithography. The significance of MEMS technology is that it becomes possible to provide mechanical parts of micron size that are batch fabricated in large quantities and are easily integrated with their associated electronics. Miniaturization to this scale is necessary for actuators to control the flow field of a 30 or 50 caliber bullet.

Device 20 operates on the basis of the electrostatic attraction of a flexible, curled film to a substrate. Initial work by the Microelectronics Center of North Carolina (MCNC) has utilized polyimide films with chrome/gold metallization. The polyimide/metal films of these structures curl due to the internal stress caused by the difference in the thermal coefficients of expansion of the gold and polyimide and the cooling from 400° C. to room temperature during the polyimide cure cycle. The electrostatic flap 36 is a partially curled flexible film 30 with one electrode 28 in the flap portion 36 and a second electrode 22 fixed to the substrate 26. The flap portion 36 is attached to the substrate 26 at one edge 56 and there is at least one insulating film 32,34 covering the electrodes 22,28 to prevent them from coming into contact with one another. The basic operation of the flap portion 36 is simple. A voltage applied between the two electrodes 22,28 establishes an electrostatic attraction. The force is strongest at the point 56 where the flexible film 30 attaches to the substrate 26. As the electrostatic force overcomes the material system rigidity, the flexible film 30 begins to unroll, which in turn creates a new area of high electric field. This process continues until the entire film 30 has flattened (unrolled) against the substrate 26. Upon the removal of the applied voltage, the residual stress in the tentured film 30 curls the material stack back to its original position as illustrated in FIG. 2. Because it is electrostatic in operation, the power requirements are very low compared to thermal and electromagnetic actuators. With the curled film 30, the separation at the point of attachment is very small, resulting in large forces, while the curl also positions the tip of the film 30 far from the substrate 26. Thus device 20 has a large range of motion, large forces and low operating voltages relative to other electrostatic actuators. Because the release of the film 34 from the substrate 26 upon the removal of the applied voltage is a curling motion, the separation occurs along a line instead of the entire area of contact. Thus, stiction is not an issue since the stress of the film 30 is larger than the attractive surface forces in the small separation area along the line of contact.

A plurality of flight control devices 20 may be mounted to the surface of the forebody ogive of projectile 10 so as not to interfere with the rifling, or at other locations depending upon the design of the particular projectile. A longitudinal strip 18 of actuators 20 may be excited together to extend the respective flap portions 36 into the stream of air flowing past the projectile 10, thereby affecting the trajectory of the projectile. By actuating selected strips 18 in a sequence responsive to the rotation of the projectile 10 about the axis of rotation 16, the control system 38 will cause a standing wave of extended flap portions 36 to be formed relative to the axis of flight 16. The excitation will rotate from one strip to the next at the same speed, but in the opposite direction to the projectile spin, thereby creating a standing wave relative to the axis of flight 16. The wave will have the effect of a de-spun control section that will be stationary with respect to the flow field and trajectory. The actuators 20 will therefore function much like conventional canard controls.

Although actuators similar to that illustrated have been made in a number of sizes and materials, they have not been designed as aerodynamic control devices, nor have they been wind tunnel tested. Individual devices 20 will be exposed to aerodynamic, inertial and electrostatic forces that are a nonlinear function of actuator displacement and shape. The aerodynamics are non-linear, the electrostatics are non-linear, because the deflections are large there are geometric non-linearities, and as the device rolls its boundary conditions change. Thus, the device 20, unlike conventional aerodynamic control devices, is not subject to simple approximations that usually initiate the design process. However, many computational fluid dynamics (CFD) codes include structural deformation, and one recently published code now includes electrostatic forces, thereby greatly easing the analysis problem. Simple CFD calculations of the basic concept of the projectile 10 has been performed. The model includes a hypothetical vehicle with a blunt nose and a single actuator. The calculations assumed 2-dimensional flow, that the flap portion 36 was rigid, 0.099 inches long with the tip at about 60°. Turbulent flow was not modeled. The results for Mach numbers 3–6 are tabulated below. The force is that due to an individual actuator and the control pressure is the force divided by the flap portion area.

| Mach | Force (lbs) | Pressure (psi) |
|---|---|---|
| 3 | 1.07 | 274 |
| 4 | 1.14 | 293 |
| 5 | 1.54 | 395 |
| 6 | 1.89 | 486 |

These forces are likely greater than that needed for vehicle control. The pressure variation associated with an actuator is highly localized relative to the projectile. The flap portion 36 will function must like a conventional spoiler. The pressure load will be mechanically transferred through the actuator to the projectile structure.

Figure 5:
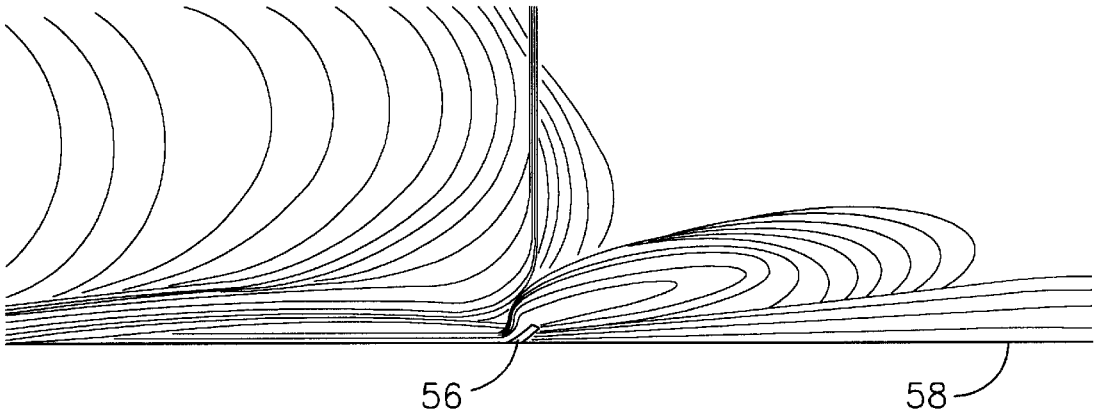
FIG. 5 illustrates a typical Mach number distribution in the neighborhood of a single actuator flap portion.

FIG. 5 shows a typical Mach number distribution in the neighborhood of a single actuator flap portion 56. The generally vertical lines above the actuator illustrate a shock wave emanating radially from the flap portion 56 and interacting with the bow shock. Aft of the secondary shock and outside the boundary layer near surface 58 there is a small disturbance due to the actuator with the remaining flow field being fairly regular. This implies that the aerodynamic design of projectile 10 as a whole will not be seriously affected by an array of such actuators. The flow immediately forward of the flap portion is at a lower Mach number than the background flow. This implies that the actuators can be moved forward toward the nose of the projectile, as they would be in an ogive nose configuration. Note that the greatest disturbance is just above the flap portion 56 with the wake flow being much less disturbed. This suggests that adjacent actuators may be spaced fairly closely together with a minimum of interaction between them.

A method of controlling the trajectory of a projectile may be appreciated from the above. By providing a plurality of micro electro-mechanical actuators on a projectile and by actuating a selected portion of the actuators in coordination with the rotational speed of the projectile, a desired change in the trajectory may be achieved. The method may include simply counteracting a disturbance to correct the projectiles flight, thereby minimizing its error but leaving it off its intended flight path. Alternatively, it may be possible to continue the correction to bring the projectile back to its intended flight path. The problem with this approach is that while the original correction is made closed loop under inertial feedback, the over correction is open loop. There is no feed back sensor to tell the auto-pilot to stop the correction. The error must therefore be integrated and remembered and the over correction continued until the integrated error is zero.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. An airborne vehicle comprising:

a housing;

a plurality of electrostatic micro electromechanical (MEMS) devices attached to the housing, each MEMS device comprising an integral control surface/actuator and having a flap portion adapted to move between a withdrawn position and an extended position; and actuator circuitry connected to the MEMS devices for selectively moving at least one of the flap portions into and out of an air stream passing over the airborne vehicle.

2. The airborne vehicle of claim 1, wherein the actuator circuitry further comprises:

a rotation sensor for producing a first signal corresponding to the rotation of the airborne vehicle about an axis of flight;

a lateral acceleration sensor for producing a second signal corresponding to acceleration of the airborne vehicle in a direction normal to the axis of flight;

control circuitry connected to the rotation sensor and to the lateral acceleration sensor for providing a third signal to the MEMS devices responsive to the first and the second signals.

3. The airborne vehicle of claim 2, wherein the plurality of MEMS devices are arranged about the axis of flight, and wherein the third signal is operable to extend selected ones of the flap portions to produce a standing wave of extended flap portions relative to the axis of flight.

4. The airborne vehicle of claim 1, wherein the MEMS devices are arranged in a plurality of longitudinal strips.

5. The airborne vehicle of claim 4, wherein the plurality of longitudinal strips are disposed about an ogive portion of the airborne vehicle.

6. The airborne vehicle of claim 1, wherein the housing has a diameter no more than that of a 50 caliber bullet.

7. The airborne vehicle of claim 1, wherein the housing has a diameter no more than that of a 30 caliber bullet.

8. The airborne vehicle of claim 1, wherein the MEMS devices each comprise:

a first fixed electrode;

the flap portion comprising a second moveable electrode disposed on a rolled layer of tentured material, the layer of tentured material having an end affixed relative to the first fixed electrode;

wherein the second moveable electrode is caused to roll toward the first fixed electrode to move the flap portion to the withdrawn position in response to an electrostatic force between the first fixed electrode and the second moveable electrode; and wherein the second moveable electrode is caused by residual stress in the tentured layer of material to roll away from the first fixed electrode to move the flap portion to the extended position.

9. An airborne vehicle comprising:

a housing;

a plurality of micro electrostatic electromechanical (MEMS) devices disposed about an axis of flight of the airborne vehicle, the MEMS devices each comprising an integral control surface/actuator having a flap portion;

a rotation sensor for producing a first signal responsive to a rate of rotation of the airborne vehicle about the axis of flight;

a lateral acceleration sensor for producing a second signal responsive to acceleration of the vehicle in a direction normal to the axis of flight; and circuitry connected to the rotation sensor and to the lateral acceleration sensor and to the plurality of MEMS devices, the circuitry operable to actuate the MEMS devices in sequence about the axis of flight at a rate of rotation responsive to the first signal and to the second signal.

10. The airborne vehicle of claim 9, wherein the MEMS devices each comprise:

a first fixed electrode;

the flap portion comprising a second moveable electrode disposed on a rolled layer of tentured material, the layer of tentured material having an end affixed relative to the first electrode;

wherein the second moveable electrode is caused to roll toward the first fixed electrode to move the flap portion to a withdrawn position in response to an electrostatic force between the first fixed electrode and the second moveable electrode; and wherein the second moveable electrode is caused by residual stress in the tentured layer of material to roll away from the first fixed electrode to move the flap portion to an extended position.

11. A method of controlling the trajectory of an airborne vehicle, thee method comprising the steps of:

providing a plurality of electrostatic micro electromechanical MEMS devices on an airborne vehicle, each MEMS device comprising an integral control surface/actuator and having a flap portion adapted to move between a withdrawn position and an extended position;

determining a desired change in trajectory of the airborne vehicle relative to an axis of flight; and actuating a selected portion of the MEMS devices to extend the respective flap portions into and out of an air stream passing over the airborne vehicle to achieve the desired change in trajectory.

12. The method of claim 11, further comprising the steps of:

disposing the MEMS devices on the airborne vehicle about the axis of flight;

sensing rotation of the airborne vehicle about the axis of flight; and actuating the selected portion of the MEMS devices in a sequence responsive to the rotation of the airborne vehicle to form a standing wave of extended flap portions relative to the axis of flight.

13. The method of claim 12 further comprising the step of disposing the MEMS devices in a plurality of longitudinal strips.

14. The method of claim 12 further comprising the step of disposing the MEMS devices in a plurality of longitudinal strips about an ogive portion of the projectile.

* * * * *